US005421756A

United States Patent [19]

Hayasaka

[11] Patent Number: 5,421,756

[45] Date of Patent: Jun. 6, 1995

[54] EXHAUST SYSTEM FOR THE MARINE PROPULSION MACHINE

[75] Inventor: Kenichi Hayasaka, Iwata, Japan

[73] Assignee: Yamaha Hatsudoki Kabushiki Kaisha, Shizuoka, Japan

[21] Appl. No.: 893,110

[22] Filed: Jun. 3, 1992

[30] Foreign Application Priority Data

Jun. 7, 1991 [JP] Japan ..... 3-163535

[51] Int. Cl.[6] ..... B63H 21/32

[52] U.S. Cl. ..... 440/89; 416/93 A

[58] Field of Search ..... 440/88, 89, 900, 57–63; 416/90 R, 90 A, 93 R, 93 A; 137/216; 55/DIG. 30; 60/310, 311; 204/147

[56] References Cited

U.S. PATENT DOCUMENTS

| | | | |
|---|---|---|---|
| 4,831,822 | 5/1989 | Yoshimura | 440/89 |
| 4,831,954 | 5/1989 | Kinouchi | 114/163 |
| 4,861,296 | 8/1989 | Wlezien | 440/89 |
| 4,887,692 | 12/1989 | Outani | 440/89 |
| 4,957,461 | 9/1990 | Nakayama | 440/89 |

FOREIGN PATENT DOCUMENTS 1-148695 6/1989 Japan .

1-204894 8/1989 Japan .

*Primary Examiner*—Robert J. Oberleitner
*Assistant Examiner*—Clifford F. Bartz
*Attorney, Agent, or Firm*—Knobbe, Martens, Olson & Bear

[57] ABSTRACT

The present invention provides an exhaust gas discharge system for a watercraft. The system has a first discharge path, including a first outlet, primarily for use during high speed vessel operation and a second discharge path, including a second outlet, for use during both low and high speed vessel operation. The first outlet is arranged to constantly remain below a water surface level of a body of water within which the watercraft is operated, while the second outlet is arranged to locate above the water level surface during high speed vessel operation and to locate below the body of water, at a level higher than the first outlet, during idle and low speed vessel operation. Additionally, the second discharge path has an exhaust flow sectional area of a size at least as large as the exhaust flow sectional area of the first discharge path. The system is capable of discharging exhaust gases in a smooth, efficient manner, and is comprised of a relatively simple structure.

25 Claims, 5 Drawing Sheets

EXHAUST SYSTEM FOR THE MARINE PROPULSION MACHINE

BACKGROUND OF THE INVENTION

This invention relates to an exhaust system for use with a watercraft propulsion arrangement. More particularly, the invention relates to an exhaust gas discharge system having one discharge path primarily for use during high speed vessel operation and another discharge path for use during both low and high speed vessel operation. The system is capable of discharging exhaust gases in a smooth manner, and is comprised of a relatively simple structure.

The treatment of exhaust gases generated during operation of watercraft propulsion units, and particularly outboard drives, is a troublesome one. With particular reference to inboard/outboard propulsion systems, an exhaust gas discharge system is known which discharges exhaust gases from an engine, disposed within the watercraft's hull, through an exhaust passage extending through a gimbal housing. The gimbal housing is secured to a rearward region of the watercraft's hull, and aids in supporting an outboard unit of the inboard/-outboard propulsion system. For example, as disclosed in Japanese Unexamined Patent Publications Hei1-148695 and Hei1-204894, it is known to employ an exhaust passage which extends alongside an engine mounted within the watercraft's hull. This passage, in turn, leads to, and communicates with, a further exhaust passage which extends through a gimbal housing. This latter exhaust passage branches, at a branching section located within the region of the gimbal housing, into: (1) a pair of auxiliary passages which extend downwardly and terminate at outlet openings located along the bottom of the gimbal housing (for low speed/idle exhaust); and (2) a main exhaust passage which extends through the outboard portion of the inboard/outboard system and ultimately leads to an outlet opening formed through a central portion of an associated propeller boss (for normal/high speed exhaust).

In the systems just described, at the exhaust passage branching section located within the region of the gimbal housing, it has been the practice to utilize a construction wherein the combined sectional flow area of the pair of auxiliary passages is less than the sectional flow area of the main exhaust passage. In accordance with such construction, during low speed and idle operation of the watercraft the engine exhaust gases are discharged into the body of water within which the watercraft is being operated through the pair of auxiliary discharge passages. This is due to the fact that the outlets associated with these passages are positioned closer to the body of water's surface, during such operational conditions, than the outlet of the main exhaust gas discharge passage. On the other hand, when operating at higher speeds, the engine exhaust gases are discharged into the body of water via the outlet associated with the main discharge passage. Such discharge may be facilitated by a lower pressure region, or pocket, relative to the pressure existent within the exhaust system, which is generated behind the propeller boss as the propulsion unit moves through the body of water.

Such prior exhaust gas discharge arrangements which utilize a main underwater exhaust passage and an auxiliary discharge system structured to locate within a body of water at a position which is not as deeply submerged as the main exhaust passage have employed a construction wherein the total flow sectional area of the auxiliary discharge system is less than the flow sectional area of the main exhaust gas discharge passage. Thus, exhaust gases have been inhibited from passing through the auxiliary system during normal/high speed engine operation in such arrangements as a result of such relative flow sectional area dimensions.

Of course, upon utilizing an engine with a greater number of cylinders in such an inboard/outboard arrangement, the volume of exhaust gas produced during high speed operation can increase over that produced by engines having lower numbers of cylinders. With such an increase in the volume of exhaust gas produced, it becomes necessary to increase the flow area of the outlet opening of the main exhaust passage in order that the exhaust gases might be smoothly discharged. In order to achieve a through the hub exhaust outlet which possesses a larger flow area, it is necessary to increase the diameter of the propeller boss. Such an increase, however, creates certain problems. For example, an increase in the diameter of the propeller boss will, in turn, create an increase in the resistance to fluid flow around the propeller boss, and the lower casing region of the outboard unit, during movement of the associated watercraft across the body of water. This increase in resistance to fluid flow will increase the turbulence about the main exhaust outlet and will, thus, hinder the smooth discharge of the exhaust gases.

It is, therefore, a principle object of the present invention to provide an improved exhaust gas discharge system for a marine propulsion unit.

It is another object of this invention to provide an improved exhaust gas discharge system for use in a marine inboard/outboard drive.

It is yet a further object of the present invention to provide an exhaust system for a marine propulsion arrangement which is comprised of a relatively simple structure and which is capable of discharging a relatively high volume of exhaust gases in a smooth manner.

As set forth above, it is well known to discharge the exhaust gases from the powering engine through an underwater exhaust gas discharge (e.g., through the hub of a propeller) so as to utilize the body of water in which the watercraft is operating as a silencing medium. Although this is a very acceptable and effective way for silencing exhaust gases under high speed running conditions, it does present certain problems in connection with low speed exhaust gas discharge. Such problems include a high back pressure within the exhaust system due to the fact that the underwater discharge is generally relatively deeply submerged coupled with the relatively low exhaust pressure generated during such operation. With an outboard motor, it is the common practice to provide a separate, above the water, exhaust gas discharge which has its own silencing system for treating the idling exhaust gases. With inboard/outboard drives, on the other hand, the powering engine usually has a larger displacement and the treatment of the exhaust gases during idling presents different problems. As depicted in the above-discussed exemplary arrangements, it has been known to employ a further auxiliary exhaust gas discharge which is also underwater when the boat is traveling at low speeds but is less deeply submerged than the high speed exhaust gas discharge. The prior arrangements utilizing such an auxiliary exhaust gas discharge have been designed so that the auxiliary discharge has a smaller flow sectional area than the main underwater exhaust gas discharge, thereby preventing exhaust gases from passing through the auxiliary system during normal/high speed engine operation. Although generally these arrangements do provide good silencing, the low speed/idle exhaust gases tend to emanate in large bubbles which can cause objectionable noise.

It is, therefore, still a further object of this invention to provide an improved silencing arrangement for the exhaust gases of an inboard/outboard drive unit.

SUMMARY OF THE INVENTION

The present invention is adapted to be embodied in an exhaust system for a drive arrangement of a watercraft. The invention includes a first passageway for discharging exhaust gases and a first outlet located at an end of the first passageway. The first outlet is arranged to constantly remain below a water surface level of a body of water within which the watercraft is operated. A second passageway for discharging exhaust gases and a second outlet are also provided. The second outlet is positioned towards an end of the second passageway and is arranged to locate at least partially out of the body of water during certain operational speeds of the watercraft, thereby providing the second outlet with a degree of restriction to exhaust gas flow therethrough which will permit a substantial portion of the total exhaust gas volume to discharge via the second outlet during such operational speeds. The second outlet is further arranged to locate below the water surface level during other operational speeds of the watercraft.

DETAILED DESCRIPTION OF THE PREFERRED EMBODIMENTS

Figure 1:
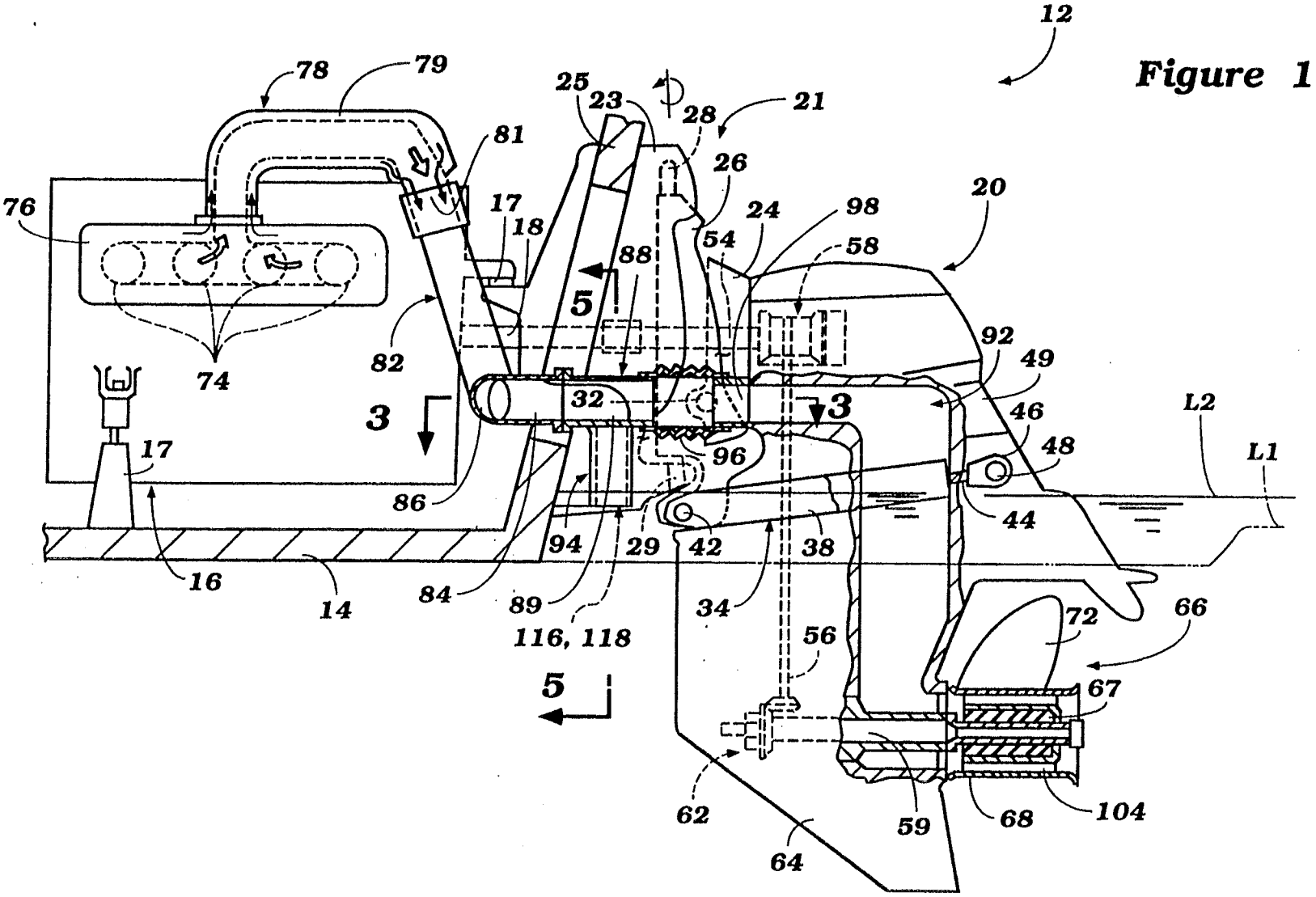
FIG. 1 is a side elevational view, of a watercraft, shown in part and with portions broken away and portions shown in phantom, powered by an inboard/outboard drive constructed in accordance with, and embodying, the present invention.

Referring now in detail to the drawings, and initially to FIG. 1, a watercraft powered by an inboard/outboard drive constructed in accordance with the present invention is shown in part and is indicated generally by the reference numeral 12. The watercraft is comprised of a hull 14 in which an internal combustion, V-type, multi-cylinder engine 16 is positioned via engine mounting units 17. The engine 16 drives an engine output shaft 18 which leads to an outboard drive unit indicated generally by the reference numeral 20.

An intermediate unit 21 is located between the engine 16 and the propulsion unit 20. The intermediate unit 21 is comprised of a number of components, including a transom plate or gimbal housing 23 that is adapted to be affixed, in a known manner, to a transom 25 of the associated watercraft 12. A gimbal ring 26 is affixed to the gimbal housing 23 and is supported for steering movement about a generally vertical steering axis defined by upper and lower pivot shafts 28 and 29, respectively.

The gimbal ring 26 is provided with a pivotal connection 32, at a point along the length of the gimbal ring 26, which defines a generally horizontally extending axis about which the propulsion unit 20 may be pivoted between a plurality of trim and tilt adjusted positions. Such tilt and trim movement of the drive 20 relative to the gimbal ring 26 is controlled by means of a hydraulically operated cylinder assembly 34, with one cylinder located towards each lateral side of the propulsion unit 20 (See FIG. 2). The cylinder assembly 34 includes cylinder units 36 and 38 which are connected to a lower portion of the gimbal ring 26 at one end by means of a pivot shaft 42. A piston rod 44 of each cylinder has a trunion portion 46 that is connected by means of a pivot pin 48 to a rearwardly located portion of an upper casing 49 of the housing of the propulsion unit 20. An oil distributor unit 52 is provided for supplying pressurized fluid from an inboard mounted reversible electric motor, pump and control circuit to the fluid chambers within each cylinder (36 and 38) in response to control signals which indicate the tilt or trim position which is desired. As a result, movement of the piston rods 44 will effect pivotal movement of the housing assembly of the propulsion unit 20 about the connection 32.

With particular reference to FIG. 1, it can be seen that the output shaft 18 extending from the engine 16 is coupled to an input shaft 54 of a transmission arrangement for the outboard drive unit 20. The input shaft 54 can selectively drive a driveshaft member 56 by means of a forward, neutral, reverse transmission arrangement, indicated generally by the reference numeral 58. The drive imparted to the driveshaft 56 is transmitted to a propeller shaft 59 by way of a bevel gear arrangement 62 located in a lower casing portion 64 of the outboard unit 20. A propeller 66, including a cylindrical boss portion 68 and outwardly extending blades 72, is fixed along the rearward end of the propeller shaft 59. A rubber damper 67 is interposed between the propeller shaft 59 and an inner portion of the propeller 66. The propeller 66 is powered selectively via the transmission arrangement 58 so as to propel the associated watercraft 12 across a body of water.

The internal combustion engine 16 is provided with a plurality of exhaust ports 74, of which one bank is illustrated in FIG. 1. Specifically, the engine 16 is V-shaped with one bank of four cylinders (and corresponding exhaust ports 74) located towards each lateral side thereof; thus, the embodiment depicted in the Figures has a total of eight cylinders. An exhaust manifold 76 is provided across each bank of cylinders and acts to collect exhaust gases emitted from the exhaust ports 74. The engine exhaust gases produced during operation of the engine 16 (indicated by the white arrows) flow from each manifold 76 into a respective conduit 78 extending upwardly of, and rearwardly along, the engine 16, and then into a Y pipe having branched exhaust passages 82 which are connected to the respective conduit 78 which is located along the same lateral side of the engine 16 as the respective exhaust ports 74.

As is typical with marine practice, a coolant jacket 79 surrounds a substantial portion of the length of each exhaust gas conduit 78. Water coolant, which is circulated through selected portions of the engine 16 for its cooling during its operation, is introduced into the jackets 79 at a location proximate the exhaust ports 74, as indicated by the blackened arrows of FIG. 1. The coolant flows along the outer perimeter of the conduit 78 until it reaches a rearward region thereof. At this rearward region the coolant water is mixed with the exhaust gases at a mixing area 81.

Figure 3:
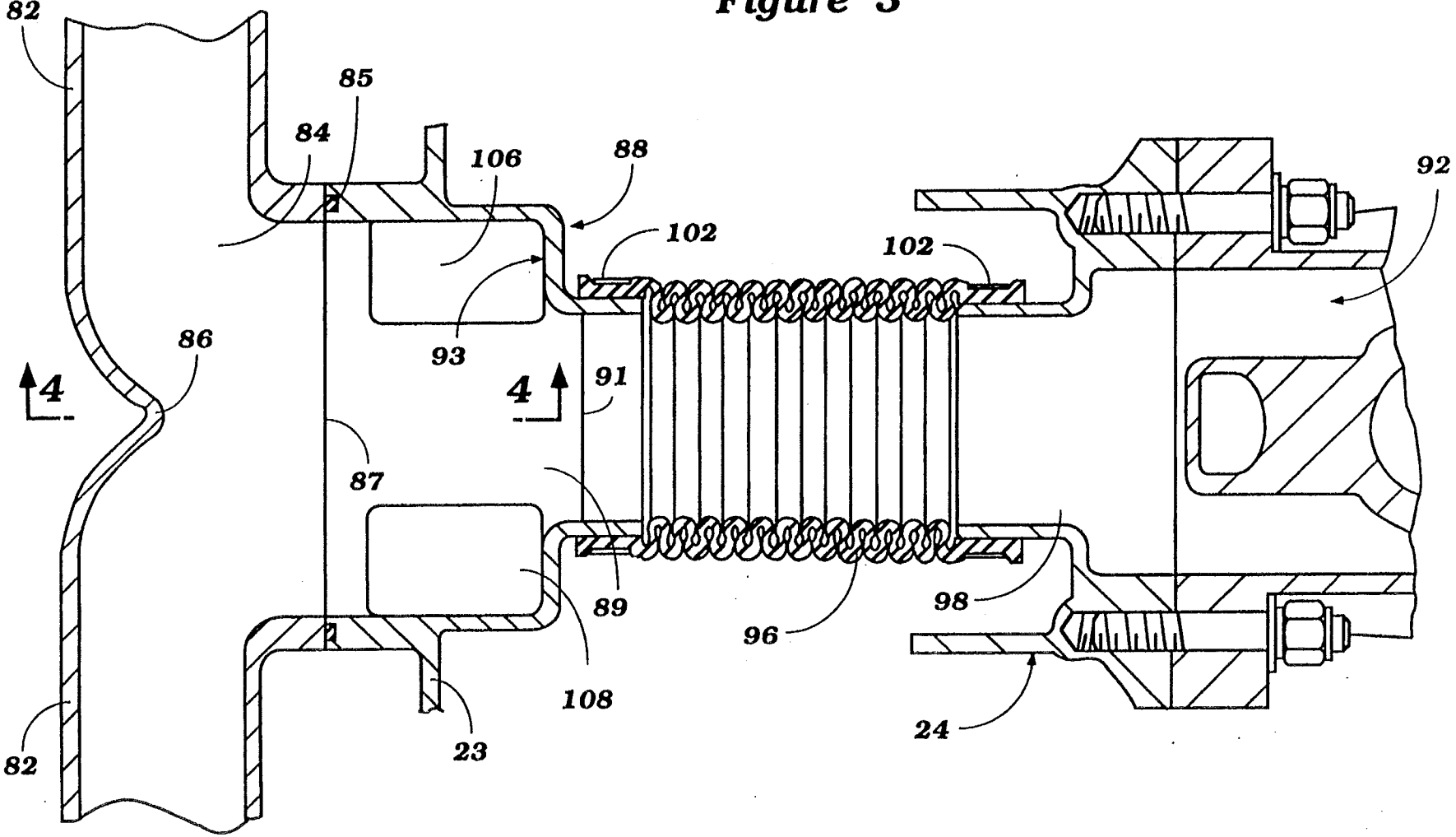
FIG. 3 is a sectional view taken along the line 3—3 of FIG. 1.
Figure 4:
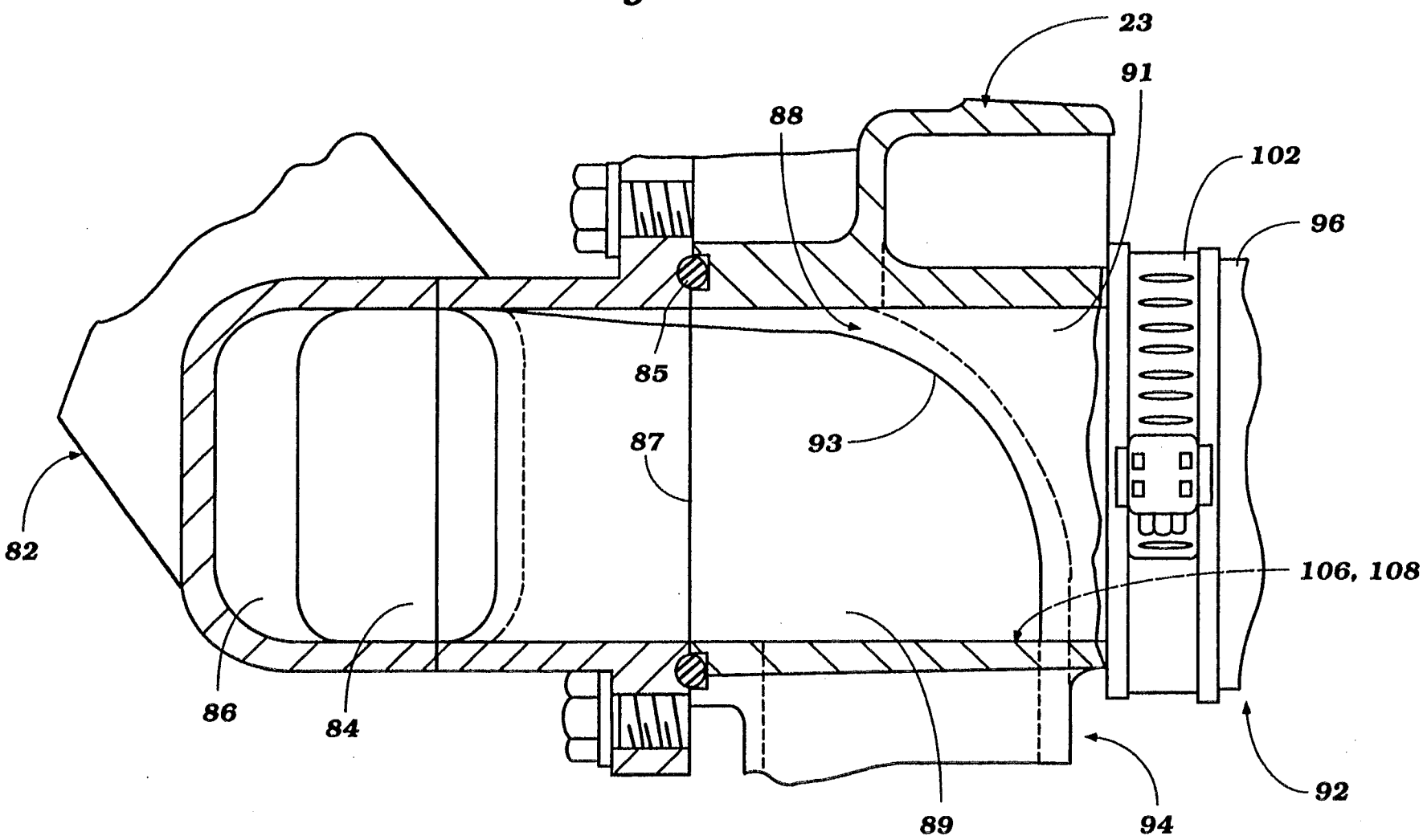
FIG. 4 is a sectional view taken along the line 4—4 of FIG. 3.

Now, referring additionally to FIGS. 3 and 4, it can be seen that the exhaust passages 82, which extend rearwardly and downwardly along each side of the engine 16, merge at their rearwardmost regions into a common joining pipe 84, which extends from a location slightly behind the engine 16 towards the rear of the watercraft 12. A curved protrusion formed midway along the lateral width of the joining pipe 84, and having an apex which extends rearwardly therein, comprises a guide wall 86 which acts to direct the exhaust gases so that they enter the joining pipe 84, and continue to travel through the exhaust system, in a smooth manner.

An exhaust pipe 88 is connected to a rearwardmost end of the joining pipe 84. An O-ring 85 is interposed between the abutting ends of the two pipes 84 and 88 so that the connection between them is maintained watertight. The exhaust pipe 88 is formed within a central region of the gimbal housing 23. It is within this exhaust pipe 88 that the exhaust system branches, at a branching region 89, into two portions; namely: (1) a main passageway 92 utilized primarily during normal and high speed vessel operation; and, (2) an auxiliary passage arrangement 94. The branching section 89 is defined by an upstream opening 87 of the pipe 88, whereat the pipe 88 abuts the rearwardmost end of the joining pipe 84; an upstream inlet 91 which constitutes the beginning of the main exhaust gas passageway 92, and which is located rearwardly of the upstream opening 87; two inlet openings (106 and 108) of the auxiliary passage arrangement 94, wherein one of such openings is located towards each lateral side of the inlet 91; and a plurality of inner wall surfaces interconnecting these structures. One such wall comprises an arched wall 93 which bridges the region between an upper portion of the opening 87 and a lower portion along the region of the inlet 91, as best seen in FIGS. 3 and 4.

The main passageway 92 begins along a rearwardmost portion of the exhaust pipe 88, at the upstream inlet 91, and continues rearwardly through the gimbal housing 23 into a flexible, tubular, bellows 96. The bellows 96 is constructed of any suitable rubber material. A forwardly located, flattened, cylindrical, end portion of the bellows 96 connects to a rearwardly located end portion of the pipe 88 via an overlapped region between the inner circumference of the bellows 96 and the outer circumference of the pipe 88, as shown in the Figures. The other end of the bellows 96 is also provided with a flattened, cylindrical, end portion. This second end of the bellows 96 is connected to a further exhaust pipe 98, which similarly constitutes a portion of the main exhaust passage 92 and constitutes a part of the propulsion unit 20, and which is situated longitudinally through the swivel bracket 24. Specifically, the bellows 96 connects to an end portion of the pipe 98 via an overlapped region between the inner circumference of the bellows 96 and the outer circumference of the pipe 98. As best seen in FIG. 3, a pair of hose clamps 102 secures the bellows 96 in place between the two exhaust pipes 88 and 98. The flexible bellows 96 allows the propulsion unit to move about its tilt/trim axis, while maintaining the integrity of the main exhaust passage 92 so that exhaust gases may continue to smoothly pass therethrough.

As best seen in FIGS. 1 and 3, the main exhaust passage 92 continues rearwardly from the pipe 98 back into the upper region 49 of the outboard unit 20. As shown in FIG. 1, the passage 92 turns downwardly, at a location rearward of the drive shaft 56, and continues into the lower region 64 of the outboard unit 20. The main passage 92 then turns rearwardly and runs along the propeller shaft 59 and is provided with an exhaust gas outlet 104 which extends through the boss 68 of the propeller 66, and which terminates at the rearwardmost portion thereof.

The through the hub exhaust gas discharge opening 104 is extremely effective in silencing the high speed exhaust gases from the engine 16. However, when operating at lower speeds, or during idle, the degree of submersion of the underwater high speed discharge 104 is too great to allow idling gases to readily pass therethrough, and the back pressure of the idling gases of the engine 16 will be so high as to impede efficient operation of the propulsion arrangement. For that reason, there is provided an auxiliary exhaust gas discharge 94, which is described below.

The auxiliary passage arrangement 94 branches downwardly from the exhaust pipe 88 at the branching region 89 thereof. Specifically, as shown in FIG. 3, a pair of openings 106 and 108 are formed, with one such opening formed to each lateral side of the exhaust pipe 88, through the exhaust pipe's 88 lower wall. These openings 106 and 108 comprise respective upstream inlets for a pair of corresponding, downwardly extending, auxiliary exhaust pipes 112 and 114 (See FIG. 5). The auxiliary exhaust pipes 112 and 114, in turn, terminate in a pair of respective auxiliary exhaust gas outlets 116 and 118 formed through the bottom region of the gimbal housing 23. It should be noted, as is readily apparent upon viewing FIG. 1, that the auxiliary exhaust gas outlets 116 and 118 are located closer to the surface of the body of water within which the watercraft is operated than the main exhaust gas outlet 104.

According to this overall construction of the exhaust system, the exhaust gases which have mixed with an amount of coolant water at the mixing region 81 pass downwardly through each of the exhaust passages 82 and continue on into the exhaust pipe 88 within the gimbal housing 23. Dependent upon the current operating conditions, a portion of the exhaust gas/coolant water mixture may pass through the main exhaust system 92 and discharge out of the outlet 104, and a portion of the exhaust gas/coolant water mixture may pass through the auxiliary exhaust system 94 and discharge out of its outlets. The coolant water of that portion which passes through, and is discharged from, the main exhaust gas system 92 will act to cool the rubber bellows 96 and the rubber damper 67, which components are located along such system. This cooling effect helps to preserve the useful life of these components.

The construction just described is intended, in part, to provide exhaust gas silencing for low speed or idle running. However, the discharge of the idling gases causes rather large exhaust gas bubbles to form which are noisy when breaking up. Accordingly, the present invention provides a baffle plate member, indicated generally by the reference numeral 122, mounted across the outlet openings 116 and 118 in order to break up these bubbles and to provide effective silencing. General details of a known auxiliary exhaust gas outlet and baffle arrangement are set forth in U.S. Pat. No. 4,957,461 to Nakayama.

Figure 2:
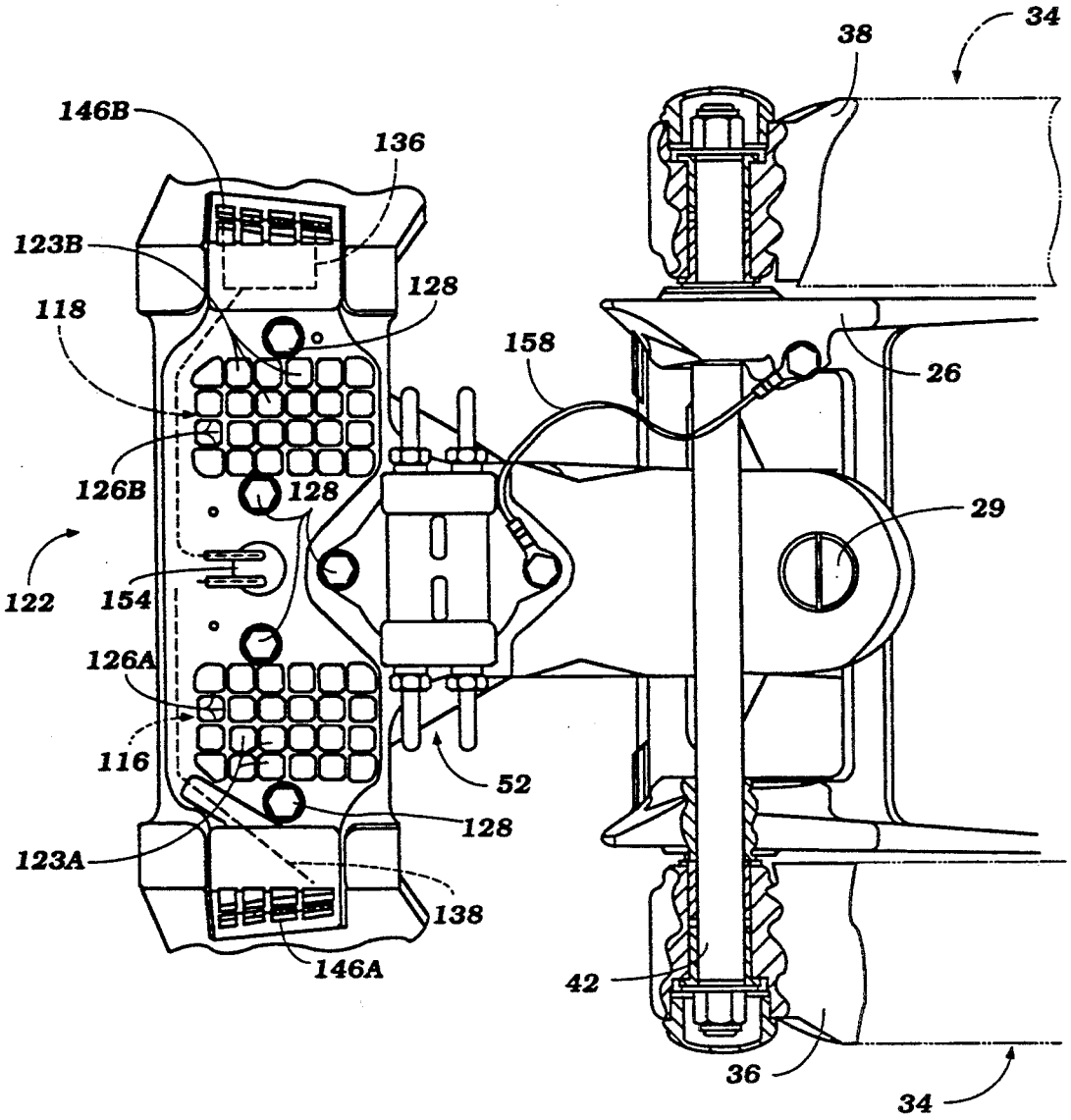
FIG. 2 is a plan view from beneath the watercraft of the invention showing portions of the electrical anticorrosion arrangement and an auxiliary exhaust gas discharge region.
Figure 5:
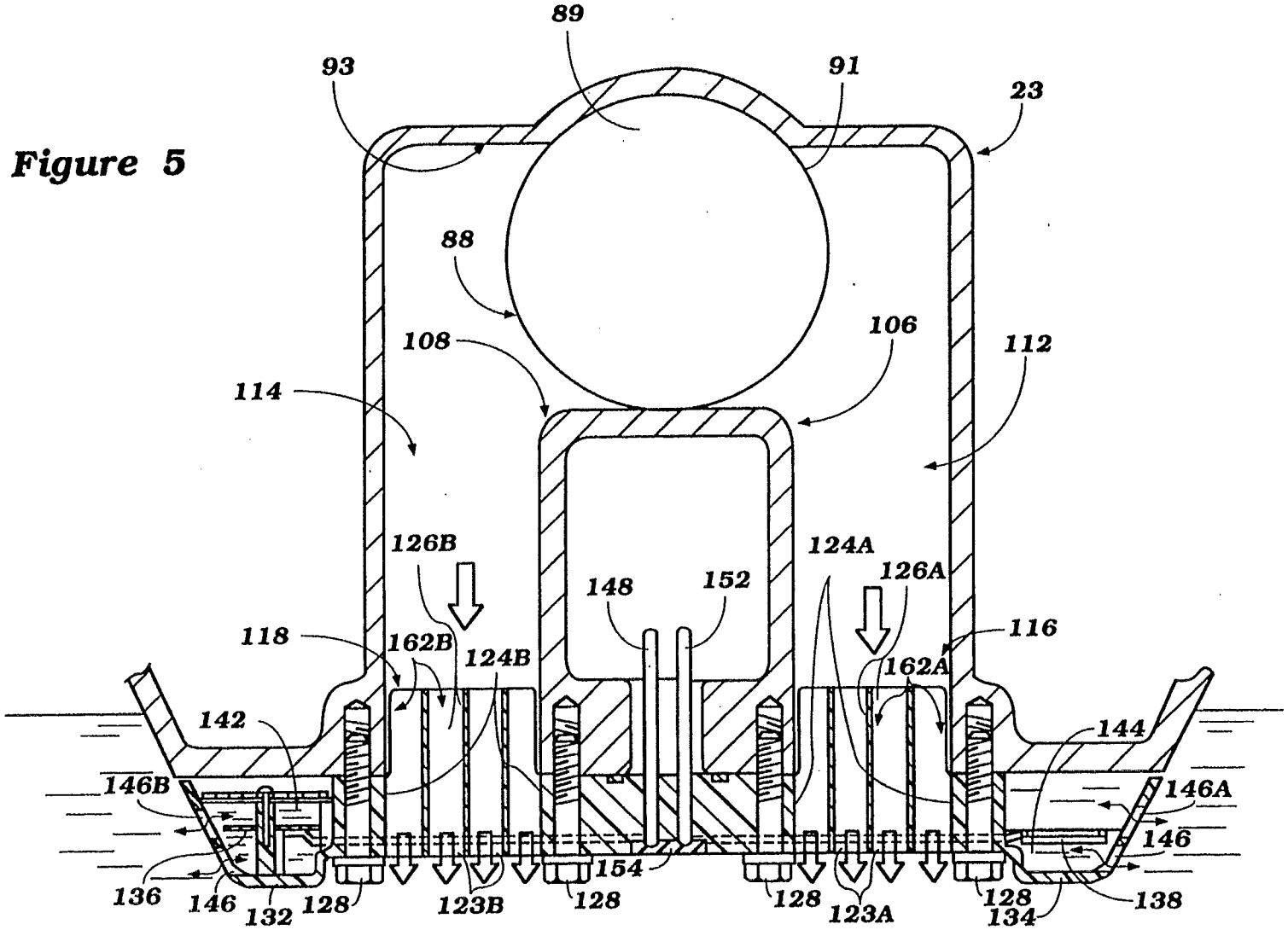
FIG. 5 is a sectional view taken along the line 5—5 of FIG. 1.

As may best be seen in FIGS. 2 and 5, the baffle 122 is comprised of a pair of exhaust gas receiving openings 124A and 124B which are generally. aligned, and register, with the discharge openings 116 and 118. The lower face of the baffle 122 is formed with a plurality of projecting ribs 126A and 126B that define a number of pockets which, in effect, provide a labyrinth type device so that the exhaust gases must flow through a plurality of the pockets before they can enter into the body of water, via multiple outlets 123A and 123B, in which the watercraft 12 is operating. As a result, the exhaust gas bubbles will be broken up into very small sizes and their rupturing will not cause an objectionable sound. In addition, the use of the baffles formed by the ribs 126A and 126B provides additional silencing by itself, apart from the breaking up of potentially large exhaust bubbles, so as to insure against objectionable noises during idling. The baffle plate 122 is formed with a plurality of openings that are adapted to pass threaded fasteners 128 so as to afford a means of attachment to the underside of the gimbal housing 23.

The baffle plate 122 serves an additional function as an electrode case for an anti-corrosion electrode arrangement of the present invention; thus, the term "electrode case" as employed hereinafter refers to element 122, as does the term "baffle plate" as employed above.

The electrode case 122 is formed of any suitable resin material, and includes an insulating material comprising the regions thereof denoted by the reference numerals 132 and 134 whereat compartments for housing the electrodes, described below, are located. An anode 136 is positioned to a lateral side of the electrode case 122 proximate the region 132. A reference electrode 138 is positioned to the other lateral side of the electrode case proximate the region 134.

The anode 136 is held within a compartment 142 defined, in part, by the surrounding regions of the electrode case 122. The reference electrode 138 is similarly held within its own compartment 144. Each of these compartments 144 and 142 is provided with a set of openings 146A and 146B which allow water to flow in and out of the compartments 144 and 142 housing the reference electrode 138 and the anode 136.

A lead wire 148 communicating with the anode 136 and a lead wire 152 communicating with the reference electrode 138 extend from their respective electrodes generally horizontally across the electrode case 122, and subsequently turn upwardly and extend through the central region of the electrode case 122. A rubber cover member 154 is embedded within the electrode case 122 directly beneath the lead wires 148 and 152 along the region at which the lead wires 148 and 152 begin their vertical ascent. The lead wires ultimately connect to the current control circuit of a control unit (not shown) at their ends remote from the ends which connect to the electrodes 136 and 138. The control unit senses the potential difference between the reference electrode 138 and the material to be protected and determines the proper electrical current necessary to supply to the anode 136 so that corrosion of such protected material may be prevented. A suitable control unit for effecting the prevention of corrosion in such a system is disclosed in copending U.S. patent application Ser. No. 07/833,090 filed on Feb. 10, 1992 by Kuragaki.

The gimbal housing 23 and the gimbal ring 26 are electrically connected via a conductive wire 158, as shown in FIG. 2. The gimbal ring 26 and the swivel bracket 24 are electrically connected via a further conductive wire (not shown). Accordingly, the components of the intermediate unit 21 and the propulsion unit 20 are in electrical communication with one another. In this way, both of these assemblies essentially share a common potential and are afforded cathodic protection by the arrangement of the invention.

Advantages provided by the construction of the cathodic protection arrangement set forth above include the fact that when the propulsion unit 20 is disposed so that its longitudinal axis is generally perpendicular to the plane of the transom 25, the distance from the anode 136 to the propulsion unit 20 is essentially the same as the distance from the reference electrode 138 to the propulsion unit 20. Therefore, the current necessary to supply to the anode 136 in order to maintain the desired potential for the most effective cathodic protection will be readily determinable. Additionally, the possibility of inadvertently supplying an excessive amount of current to the anode 136 can be avoided, since the control circuit assembly will have an accurate indication of the actual present potential at the material to be protected. Furthermore, the electrode case 122 is readily removable via the threaded fasteners 128 for easy access when servicing or the like is required.

As set forth above, the prior exhaust gas discharge arrangements which utilize a main underwater exhaust passage and an auxiliary discharge system structured to locate within a body of water at a position which is not as deeply submerged as the main exhaust passage have employed a construction wherein the total flow sectional area of the auxiliary discharge system is less than the flow sectional area of the main exhaust gas discharge passage. Thus, exhaust gases have been inhibited from passing through the auxiliary system during normal/high speed engine operation in such arrangements as a result of such relative flow sectional area dimensions.

With reference once again to the Figures as they relate to the main and auxiliary exhaust gas discharge systems (92 and 94, respectively), the present invention provides an arrangement wherein the combined flow sectional areas of the two passages 112 and 114 of the auxiliary discharge system 94, from inlets 106 and 108 at the branching region 89 to the outlets 116 and 118, is structured to be approximately equal to, or greater than, the flow sectional area of the main discharge system 92, from the inlet 91 at the branching region 89 to the main outlet 104.

More specifically, as contemplated by the present invention, where a1 and a2 denote the flow sectional areas of each of the two exhaust passages 82 which extend rearwardly and downwardly along each side of the engine 16, respectively; and where b denotes the area of the upstream opening 87 of the pipe 88; b is structured to comprise a quantity approximately equal to, or any quantity down to about 70% of, the quantity defined by the sum of the areas a1 and a1. Further, where c1 and c2 denote the flow sectional areas of the two passages 112 and 114, respectively, of the auxiliary discharge system 94; and where d denotes the flow sectional area of the main discharge system 92, from the inlet 91 to the main outlet 104, the following relationships are observed:

$$(a1+a2) \geqq b \approx (c1+c2+d) > (c1+c2) > d.$$

The outlets 123A and 123B of the auxiliary exhaust gas system 94 are arranged so that they are positioned higher than the surface level of the body of water within which the watercraft 12 is operated, at least during high speed operation of the vessel. This water level is indicated by the reference character L1. Thus, under such operating conditions, the outlets 123A and 123B are located opposite the water surface level L1, as shown in FIG. 1. The outlets 123A and 123B of the auxiliary exhaust gas system 94 are arranged so that they are positioned below the surface level of the body of water within which the watercraft 12 is operated at low speed or during idle. This water level is indicated by the reference character L2. Accordingly, under low speed and idle operating conditions the outlets 123A and 123B are located beneath the water surface level L2.

The main exhaust gas discharge outlet 104 of the main discharge system 92 is arranged so that it always remains beneath the surface level of the body of water within which the watercraft 12 is operated under all operating conditions (i.e., from idle to high speed operation).

Each of the auxiliary outlets 116 and 118 of the passages 112 and 114 are provided with throttle arrangements 162A and 162B. The total combined flow sectional areas of the throttle arrangements 162A and 162B are arranged to be less than that of the exhaust passages 112 and 114. These throttle arrangements 162A and 162B are integrally formed with the electrode case/baffle plate structure 122. Specifically, the throttle arrangements 162A and 162B comprise a plurality of small passageways, with their boundaries being defined by the ribs 126A and 126B.

More specifically, as contemplated by the present invention, where g1 and g2 represent the combined sectional areas of the ribs 126A and 126B themselves, respectively; and where e1 and e2 comprise the combined flow sectional areas of the outlets 123A and 123B, respectively; the following relationships are observed:

(1) $c1-g1=e1$; and, (2) $c2-g2=e2$.

According to the construction set forth above, the relationship between the flow sectional areas e1 and e2 of the outlets 123A and 123B and the flow sectional areas c1 and c2 of the auxiliary exhaust system passages 112 and 114 is as follows:

(1) $e1<e1$; and, (2) $e2<c2$.

Additionally, the relationship between the flow sectional areas e1 and e2 of the outlets 123A and 123B and the flow sectional area d of the main exhaust system 92, from the branching area 89 to the main exhaust outlet 104, is set as follows: $(e1+e2)>d$.

The throttling of the sectional flow area within the auxiliary discharge system 92 allows the system to be tuned so that certain reflection waves may be produced by the exhaust gases therein during high speed vessel operation in order to enhance engine performance.

The above-described construction not only allows an amount of the exhaust gases to quietly discharge the system through the auxiliary passage arrangement 94 during low speed/idle operation; but additionally, as a result of the relative flow sectional areas employed, and the fact that the auxiliary outlets are located above the water surface level L1 during high speed operation and, thus, will not subject exiting gases to water induced back pressure, a portion of the exhaust gases may readily pass therethrough when operating the vessel at such higher speeds.

These exhaust gases exiting the auxiliary discharge system 94 will be directed towards the water surface L1 since the auxiliary discharge outlets are located opposite the water surface L1 during high speed vessel operation. When these exhaust gases impinge upon the water's surface the energy of the exhaust noise is dampened, and so exhaust noise is thereby reduced.

Since the exhaust arrangement of the present invention helps to smoothly direct the exhaust gases along the system, as by way of the guide wall 86 at the joining pipe and the arched wall 93 at the branching section 89 of the pipe 88; and, additionally, since a portion of the exhaust gases are allowed to exit through the auxiliary passage arrangement 92 even under high speed operating conditions, the amount of exhaust gases which pass through the main discharge arrangement 94 under high speed conditions will not become excessively large as to overload the capacity of the main discharge arrangement 94 and hinder engine performance. Therefore, according to the construction described herein, it is not necessary to increase the diameter of the high speed discharge outlet in order to accommodate the quantity of exhaust gases generated during high speed engine operation. So, the disadvantages of a larger diameter hub, which might otherwise be necessitated in a through the hub high speed discharge arrangement, are presently avoided.

The foregoing description is, of course, only that of a preferred embodiment of the invention, and various changes and modifications may be made without departing from the spirit and scope of the invention, as defined by the appended claims.

It is claimed:

1. An exhaust system for a drive arrangement of a watercraft, comprising a first passageway for discharging exhaust gases and a first outlet located at an end of said first passageway, said first outlet being arranged to constantly remain below a water surface level of a body of water within which said watercraft is operated; a second passageway for discharging exhaust gases and a second outlet positioned towards an end of said second passageway; wherein said second outlet is arranged to locate at least partially out of said body of water during certain operational speeds of the watercraft; said second outlet being provided with a low degree of restriction to exhaust gas flow therethrough during said operational speeds, during which said second outlet locates at least partially out of said body of water; an ample portion of the total exhaust gas volume being smoothly discharged via said second outlet during said operational speeds during which said second outlet locates at least partially out of said body of water; wherein said second outlet is further arranged to locate below said water surface level during other operational speeds of said watercraft; and wherein said second passageway has an exhaust flow sectional area of a size at least as large as an exhaust flow sectional area of said first passageway.

2. The exhaust system of claim 1 wherein said second outlet faces downwardly; and further comprising an air gap positioned between said second outlet and said water surface level such that any exhaust gases which are discharged from said second outlet must flow through said air gap.

3. The exhaust system of claim 1 wherein the exhaust flow sectional area of said second passageway is greater than the exhaust flow sectional area of said first passageway.

4. The exhaust system of claim 1 wherein said second outlet is positioned along a generally horizontal plane which is vertically above said first outlet.

5. The exhaust system of claim 1 further comprising an outboard propulsion unit, said propulsion unit including a propeller mounted thereupon; wherein said first outlet extends longitudinally through a hub of said propeller.

6. The exhaust system of claim 5 further comprising a tilt/trim adjustment system connected to said outboard propulsion unit for moving said outboard unit about a generally horizontal axis; and wherein said first outlet includes a portion extending through a flexible bellows, wherein said bellows permits exhaust gases to pass therethrough while said outboard unit is moved about said horizontal axis.

7. The exhaust system of claim 6 further comprising an internal combustion engine having a circulating coolant water system; and further comprising an exhaust gas/coolant water mixing region located within said exhaust system at a position upstream of said first passageway and whereat a portion of coolant which circulates through said coolant water system is mixed with said exhaust gases so that mixed coolant water is able to cool said bellows during engine operation.

8. The exhaust system of claim 5 wherein said propulsion arrangement is an inboard/outboard type propulsion system which includes a gimbal housing and said outboard propulsion unit, wherein said gimbal housing aids in mounting said outboard propulsion unit; and wherein said second passageway is formed through a lowermost portion of said gimbal housing.

9. The exhaust system of claim 8 further comprising a baffle plate, wherein said baffle plate covers said second outlet and extends up into said second passageway; wherein said baffle plate is operative to restrict the effective size of said outlet and to redirect the flow of exhaust gases emanating from said second outlet in order to break up the size of exhaust gas bubbles emanating from said second outlet.

10. The exhaust system of claim 9 further comprising an anode housed within said baffle plate towards one lateral side thereof and a reference electrode housed within said baffle plate towards an opposing lateral side thereof; said anode and reference electrode comprising portions of an electrical anticorrosion arrangement.

11. The exhaust system of claim 8 wherein said first passageway is operational to discharge exhaust gases from said exhaust system primarily during high speed operation of said watercraft.

12. The exhaust system of claim 11 wherein said second passageway is operational to discharge exhaust gases throughout a range of operational speeds of said watercraft; said range including idle operation, low speed operation and high speed operation.

13. An exhaust system for a drive arrangement of a watercraft, comprising a first passageway for discharging exhaust gases of a first outlet located at an end of said first passageway, said first outlet being arranged to constantly remain below a water surface level of a body of water within which said watercraft is operated; a second passageway for discharging exhaust gases and a second outlet positioned towards an end of said second passageway; wherein said second outlet is arranged to locate at least partially out of said body of water during certain operational speeds of said watercraft; said second passageway being operational to discharge exhaust gases throughout a range of operational speeds of said watercraft; said range including idle operation, low speed operation and high speed operation; said second outlet being provided with a low degree of restriction to exhaust gas flow therethrough during said operational speeds, during which said second outlet locates at least partially out of said body of water; an ample portion of the total exhaust gas volume being smoothly discharged via said second outlet during said operational speeds during which said second outlet locates at least partially out of said body of water; wherein said second outlet is further arranged to locate below said water surface level during other operational speeds of said watercraft; and wherein said second passageway is provided with a main unrestricted portion and a throttle portion, wherein an exhaust flow sectional area of said throttle portion is less than an exhaust flow sectional area of said main unrestricted portion; however, the exhaust flow sectional area of said throttle portion is at least as great as the exhaust flow sectional area of said first passageway.

14. The exhaust system of claim 13 further comprising a plurality of engine exhaust ports and a pair of manifolds, said manifolds positioned proximate said exhaust ports to collect exhaust gases emitted from said exhaust ports; and further comprising a pair of exhaust gas conduits wherein each one of said conduits leads from a corresponding one of said manifolds to a single joining pipe whereat said exhaust gas conduits merge; and further comprising an exhaust system branching pipe, said exhaust system branching pipe communicating with said single joining pipe and having a branching section whereat said first passageway begins and whereat said second passageway begins; wherein said branching pipe has an upstream inlet region which has a flow sectional area which is from 70% to 100% the size of the combined flow sectional areas of said exhaust gas conduits.

15. The exhaust system of claim 14 further comprising an exhaust gas guide wall formed within said single joining pipe, wherein said guide wall is operative to help smoothly mix and direct said exhaust gases which pass into said single joining pipe from said pair of exhaust gas conduits onward through said exhaust system.

16. The exhaust system of claim 14 wherein the flow sectional area of said upstream inlet region of said branching pipe is of a size approximately equal to the total combined flow sectional areas of said first passageway and said second passageway.

17. The exhaust system of claim 14 further comprising an arched wall within said branching pipe which arcs downwardly from a forward region thereof towards a rearward region thereof, said arched wall operational to smoothly guide said exhaust gases along said exhaust system.

18. The exhaust system of claim 16 wherein said second passageway includes a pair of generally vertically extending passages.

19. The exhaust system of claim 16 wherein said throttled portion of said second passageway is comprised of a baffle plate; wherein said baffle plate covers said second outlet and extends up into said second passageway; wherein said baffle plate is operative to restrict the effective size of said outlet and to redirect the flow of exhaust gases emanating from said second outlet in order to break up the size of exhaust gas bubbles emanating from said second outlet.

20. The exhaust system of claim 19 further comprising an anode housed within said baffle plate towards one lateral side thereof and a reference electrode housed within said baffle plate towards an opposing lateral side thereof; said anode and reference electrode comprising portions of an electrical anticorrosion arrangement.

21. An exhaust system for a drive arrangement of a watercraft, comprising a first passageway for discharging exhaust gases and a first outlet located at an end of said first passageway, said first outlet being arranged to constantly remain below a water surface level of a body of water within which said watercraft is operated; a second passageway for discharging exhaust gases and a second outlet positioned towards an end of said second passageway; wherein said second outlet is arranged to locate at least partially out of said body of water during high operational speeds of said watercraft; means providing said second outlet with a degree of restriction to exhaust gas flow therethrough, which will permit an ample portion of the high operational speed exhaust gas volume to discharge via said second outlet; wherein said means includes a structural arrangement wherein said second passageway has an exhaust flow sectional area of a size at least as large as an exhaust flow sectional area of said first passageway; and wherein said second outlet is further arranged to locate below said water surface level during other than high operational speeds of said watercraft.

22. An exhaust system for a drive arrangement of a watercraft, comprising a first passageway for discharging exhaust gases and a first outlet located at an end of said first passageway, said first outlet being arranged to constantly remain below a water surface level of a body of water within which said watercraft is operated; a second passageway for discharging exhaust gases and a second outlet positioned towards an end of said second passageway; wherein said second outlet is arranged to locate at least partially out of said body of water during high operational speeds of said watercraft; wherein said second outlet is further arranged to locate below said water surface level during other than high operational speeds of said watercraft; and wherein said second passageway is configured to permit a sufficient portion of the total high operational speed exhaust gas volume to discharge through said second outlet during high operational speeds so that the balance of said total high operational speed exhaust gas volume, which is discharged through said first outlet, is less than the capacity of the first passageway.

23. The exhaust system of claim 22 wherein said second passageway has an exhaust flow sectional area at least as large as an exhaust flow sectional area of said first passageway.

24. The exhaust system of claim 23 additionally comprising a plurality of engine exhaust ports, at least a first and a second manifold, said manifolds coupled to said ports to collect exhaust gases emitted through said exhaust ports, and at least a first and a second exhaust gas conduit, said first conduit coupling said first manifold to a joining pipe and said second conduit connecting said second manifold to said joining pipe, said joining pipe having an exhaust flow sectional area approximately equal to the combined exhaust flow sectional area of said first and second passageways.

25. The exhaust system of claim 24, wherein joining pipe has an exhaust flow sectional area at least as large as 70% of the combined exhaust flow sectional areas of said first and second exhaust gas conduits.

* * * * *